US006311029B1

(12) United States Patent
Sumio et al.

(10) Patent No.: US 6,311,029 B1
(45) Date of Patent: Oct. 30, 2001

(54) IMAGE FORMING APPARATUS HAVING SHEET FEEDING UNIT FOR INSERT SHEETS WITH A JOB DATA AND INSERT SHEET IDENTIFICATION CONTROL FEATURE

(75) Inventors: Hiroshi Sumio, Tokyo; Hirohiko Ito, Yokohama; Nobuaki Miyahara; Bungo Shimada, both of Tokyo, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/433,045

(22) Filed: Nov. 3, 1999

(30) Foreign Application Priority Data

Nov. 11, 1998 (JP) ..... 10-321093
Nov. 13, 1998 (JP) ..... 10-324228

(51) Int. Cl.[7] ..... G03G 15/04
(52) U.S. Cl. ..... 399/82; 399/84
(58) Field of Search ..... 399/82, 8, 16, 399/83, 84, 87

(56) References Cited

U.S. PATENT DOCUMENTS 5,561,500 10/1996 Ohzeki et al. ..... 355/202
5,877,867 * 3/1999 Ishimoto et al. ..... 358/296
6,041,200 * 3/2000 Glass et al. ..... 399/82

FOREIGN PATENT DOCUMENTS 10-000834 1/1988 (JP) .
10-052966 2/1988 (JP) .
10-187372 7/1988 (JP) .
2-241265-A * 9/1990 (JP) .
8-274974 10/1996 (JP) .
08-274974 10/1996 (JP) .
09-048165 2/1997 (JP) .

OTHER PUBLICATIONS

European Search Report dated Mar. 13, 2000.

* cited by examiner

*Primary Examiner*—Quana M. Grainger
(74) *Attorney, Agent, or Firm*—Fitzpatrick, Cella, Harper & Scinto

(57) ABSTRACT

A printing apparatus including print sheet feeding unit for feeding a print sheet, receiving unit for receiving image data and an identification of the image data from a personal computer, printing unit for printing an image on the print sheet fed by the print sheet feeding unit in accordance with the image data received by the receiving unit, insert sheet feeding unit for feeding a insert sheet, operation panel for inputting an identification of the insert sheet by a user, control unit for control the insert sheet feeding unit to feed the insert sheet in accordance with the identification of the image data corresponding to the identification of the insert sheet.

45 Claims, 15 Drawing Sheets

IMAGE FORMING APPARATUS HAVING SHEET FEEDING UNIT FOR INSERT SHEETS WITH A JOB DATA AND INSERT SHEET IDENTIFICATION CONTROL FEATURE

BACKGROUND OF THE INVENTION

1. Field of the Invention

The present invention relates to an image forming apparatus having an insert sheet feeding unit other than a print sheet feeding unit.

2. Description of the Related Art

When two groups of printed sheets, for example sheets printed by a color printer and sheets printed by a monochrome printer, are collated together, manual techniques require a user to collate the two groups by himself or herself. To solve this problem, it has been proposed to provide a color printer with an inserter, so as to feed insert sheets. For example, Japanese Patent Application Laid Open No. 8-274974 describes a situation in which print data for both monochrome pages and color pages are printed and collated together. First, monochrome print data is sent from a computer to a monochrome printer for printout of monochrome pages. A user takes the monochrome pages and places them on an inserter or specific feeder of a color printer. Thereafter, the color print data is sent to the color printer that prints out color pages and collates the color pages together with the monochrome pages.

A problem arises with such an arrangement when the color printer is connected to a network connected to a plurality of computers. Specifically, the monochrome pages mounted on the feeder for one user can become accidentally collated with color pages printed by another user.

SUMMARY OF THE INVENTION

An object of the present invention is to provide an image forming apparatus and a driver software for the apparatus which can prevent accidental collation of insert sheets from one user with printed sheets from another user.

In order to achieve the above object, the present invention provides an image forming apparatus comprising a print sheet feeder for feeding a print sheet, a first terminal for receiving image data and an identification of the image data from another apparatus, image forming means for forming an image on the print sheet fed by said print sheet feeding means in accordance with the image data received by said receiving means, an insert sheet feeder for feeding an insert sheet; a second terminal for receiving an identification of the insert sheet, and a controller for controlling said insert sheet feeder to feed the insert sheet in a case where the identification of the image data corresponds to the identification of the insert sheet.

Other objects and features of the invention will be apparent from the following description and the drawings.

DESCRIPTION OF THE PREFERRED EMBODIMENTS

Figure 1:
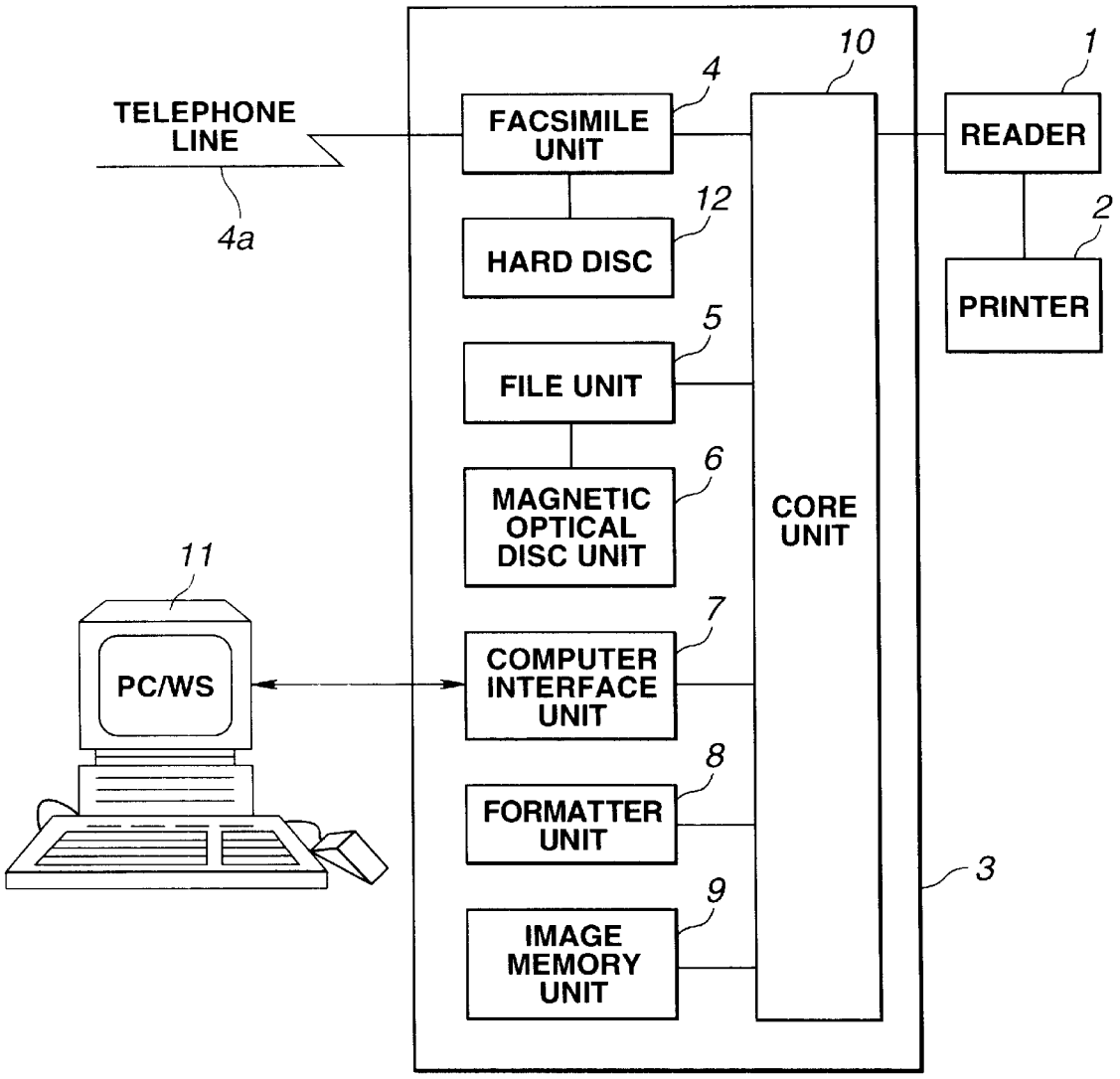
FIG. 1 shows a system structure of an image forming apparatus.

FIG. 1 shows a system structure of an image forming apparatus. The image forming apparatus is comprised of reader 1, printer 2, and image I/O control unit 3. Image I/O control unit 3, which is connected to personal computer 11 and telephone line 4*a,* controls various I/O processes. Reader 1 reads an image of an original, and outputs image data according to the original image to printer 2 and image I/O control unit 3. Printer 2 prints an image on a sheet in accordance with image data received from reader 1 and image I/O control unit 3.

Image I/O control unit 3 is connected to reader 1, and includes facsimile unit 4, file unit 5, computer interface unit 7, formatter unit 8, image memory unit 9, and core unit 10. Facsimile unit 4 decompresses compressed image data received through telephone line 4*a*. Facsimile unit 4 compresses image data transferred from core unit 10, and sends the compressed image data through telephone line 4*a*. Hard disc 12 is connected to facsimile unit 4, and temporarily stores the compressed image data received. Magnetic optical disk unit 6 is connected to file unit 5. File unit 5 compresses image data transferred from core unit 10, stores the compressed image data in a magnetic optical disk, which is set in magnetic optical disk unit 6, with a key word which is for retrieving the image data. File unit 5 retrieves compressed image data stored in the magnetic optical disk in accordance with a key word transferred through core unit 10, decompresses the compressed image data retrieved, and transfers the decompressed image data to core unit 10.

Computer interface unit 7 is the interface between a personal computer (or workstation) 11 and core unit 10. Computer interface unit 7 receives image data and code data. Personal computer 11 is connected to computer interface unit 7 through a network such as a LAN. Formatter unit 8 converts code data, which is transferred from computer 11, into image data which is printable by printer 2. Image memory unit 9 temporarily stores data transferred from computer 11 or data converted by formatter unit 8. Core unit 10 controls flow of data between reader 1, facsimile unit 4, file unit 5, computer interface unit 7, formatter unit 8, and image memory unit 9.

Figure 2:
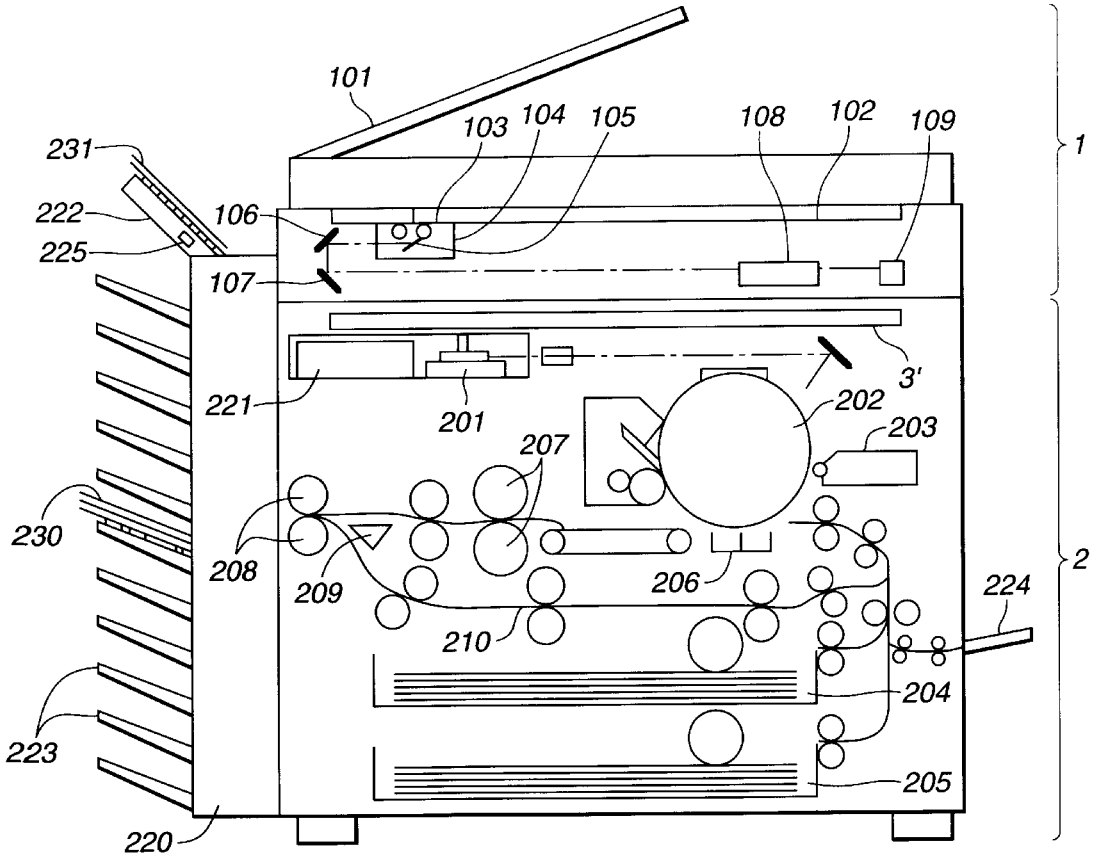
FIG. 2 shows a structure of a reader and a printer.

FIG. 2 shows a structure of reader 1 and printer 2. Document feeder 101 feeds documents to platen glass 102 one by one in the reverse order from the last page, and discharges the original from platen glass after the original has been read. Lamp 103 is turned on when the original is set on platen glass 102. Then the original is scanned by scanner unit 104.

The reflected light from original is led to CCD image sensor (CCD) 109 by mirrors 105, 106, and 107, and by lens 108. Thereby the scanned original image is read by CCD 109. Image data output from CCD 109 is processed and then transferred to printer 2 and core unit 10 of image I/O control unit 3. Laser driver 221 of printer 2 drives laser emission unit 201. Laser driver 221 causes laser emission unit 201 to emit laser beams in accordance with image data output from reader 1. The laser beams expose photosensitive drum 202 and form a latent image on photosensitive drum 202. Developer 203 causes developing material to adhere onto the latent image on photosensitive drum 202. A sheet is fed from one of cassette 204 and 205 to transfer unit 206, where developing material adhered onto photosensitive drum 202 is transferred onto the fed sheet. Fixing unit 207 fixes the developing material to the sheet by heat and pressure. Discharge roller 208 discharges the fixed sheet from printer 2. Sorter 220 sorts the discharged sheets by transporting the sheet to one of plural bins 223 of sorter 220. Sorter 220 transports the discharged sheets to an upper bin when a sort mode is not set.

A sheet feed unit 222 for feeding insert sheets (hereinafter, an "inserter", is provided in sorter 220. Sensor 225 detects an insert sheet 231 set on inserter 222. Sorter 220 causes inserter 222 to feed an insert sheet 231 which is set on inserter 222, and transport it onto the printed sheet which is discharged from printer 2 and stacked on one of bins 223, in accordance with a indication from printer 2. That is, the printed sheet and the insert sheet are discharged to one bin. Insert sheet 231 fed by inserter 222 is discharged without going through printer 2. In this way, the printed sheets and the insert sheet 231 are stacked on one bin 223 as a bunch of sheets. For example, sheets printed by a color printer are set on inserter 222, because printer 2 can print only a monochrome image. Sorter 220 collates monochrome image sheets discharged from printer 2 and color image sheets set on inserter 222. Sorter 220 has a stapler which can staple sheets stacked on bins 223.

When a two sided print is set in printer 2, discharge roller 208 is reversed after the trailing edge of the sheet passes over flapper 209. Then the sheet is led to re-feed path 210 by discharge roller 208 and flapper 209. When a multiple print is set, flapper 209 leads the leading edge of the sheet to re-feed path 210 before the leading edge of the sheet reaches to discharge roller 208. The sheet led into re-feed path 210 is fed at the aforementioned timing. Numeral 224 indicates a manual feed unit for printed sheets.

Figure 3:
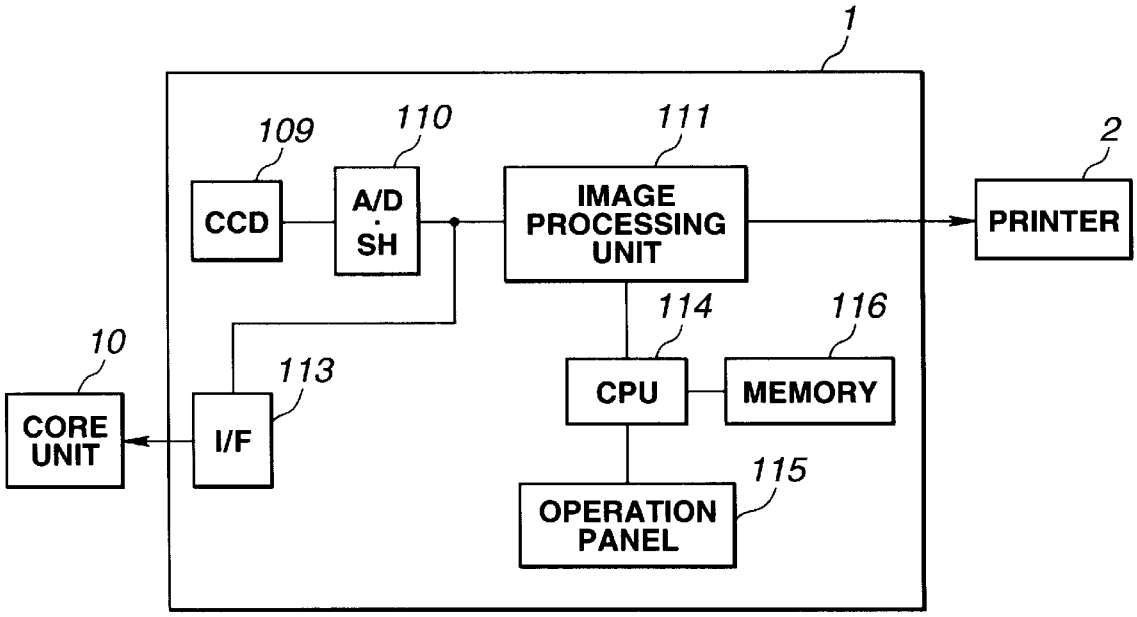
FIG. 3 shows a block diagram of the reader.

FIG. 3 shows a block diagram of reader 1. A/D-SH unit 110 converts analog data output from CCD 109 into digital data and performs shading compensation the data. Image data processed by A/D-SH unit 110 are transferred to printer 2 through image processing unit 111 and transferred to core unit 10 through interface 113. CPU 114 controls image processing unit 111 and interface 113 in accordance with designations input by a user at operation panel 115. For example, when a trimming mode is set by operation panel 115, CPU 114 controls image processing unit 111 to perform a trimming processing and transfer the processed image data to printer 2. When a facsimile transmit mode is set by operation panel 115, CPU 114 transfers image data and a control command according to the set mode to core unit 10 through interface 113. A program of CPU 114 is stored in memory 116 and is referred by CPU 114. The program will be described later. The program could be stored in a memory medium such as a floppy disc and a CD-ROM. The memory medium can be read by CPU 114 or another CPU in the image forming apparatus.

Figure 4:
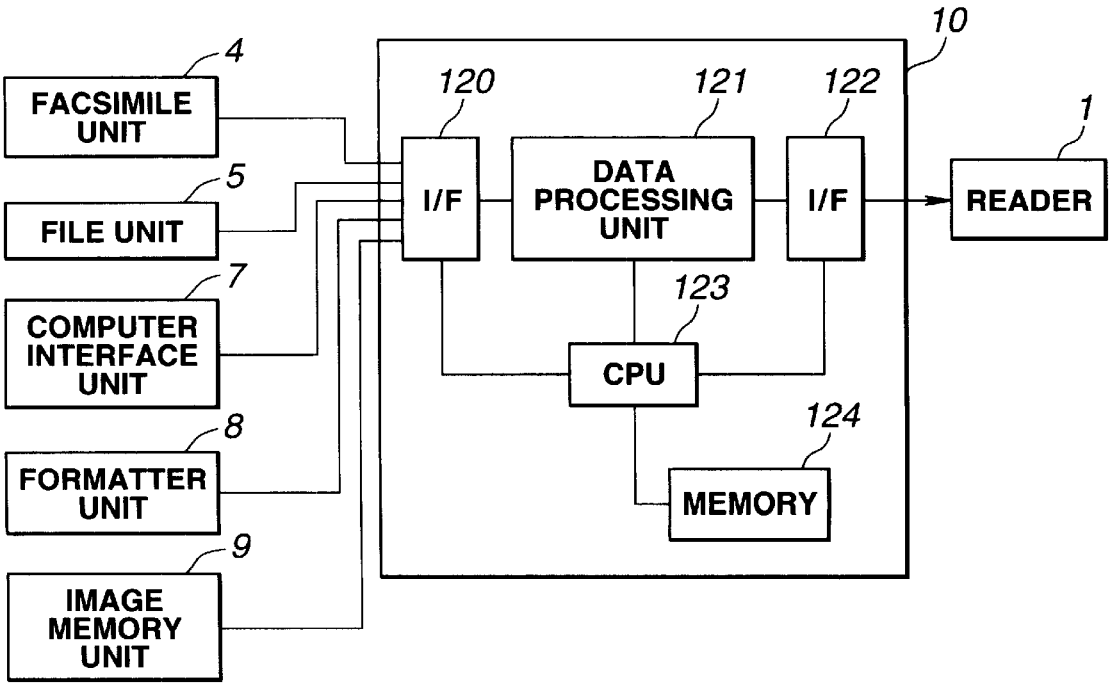
FIG. 4 shows a block diagram of a core unit.

FIG. 4 shows a block diagram of core unit 10. Image data received from reader 1 are transferred to data processing unit 121. Control commands received from reader 1 are transferred to CPU 123. Data processing unit 121 performs rotation processing and magnification processing of image and the like. Data processing unit 121 transfers image data to facsimile unit 4, file unit 5, and computer interface unit 7 through interface 120 in accordance with a control command transferred from reader 1.

Code data representing an image are transferred to formatter unit 8 through computer interface unit 7 and data processing unit 121. Formatter unit 8 converts the code data into image data and transferred to facsimile unit 4 and printer 2 through data processing unit 121. Image data received from facsimile unit 4 are transferred to printer 2, file unit 5, and computer interface unit 7 through data processing unit 121. Image data received from file unit 5 are transferred to printer 2, facsimile unit 4, and computer interface unit 7 through data processing unit 121.

CPU 123 performs a control in accordance with a control program stored in memory 124 and control commands transferred from reader 1. Memory 124 is also used for a work area of CPU 123. As described above, it is able to perform a processing combined among reading an original, printing an image, transmitting an image, receiving an image, filing an image, and inputting and outputting image data for personal computer 11.

A processing performed by CPU 114 in reader 1 will be described with reference to FIGS. 5 to 7. The process steps shown in these figures are stored as computer executable process steps in a computer-readable medium such as memory 116. First, the processing shown in FIG. 6 is executed once when the power of the image forming apparatus is turned on. When the image forming apparatus is turned on, CPU 114 sets 0 in a variable N (S602).

Figure 5:
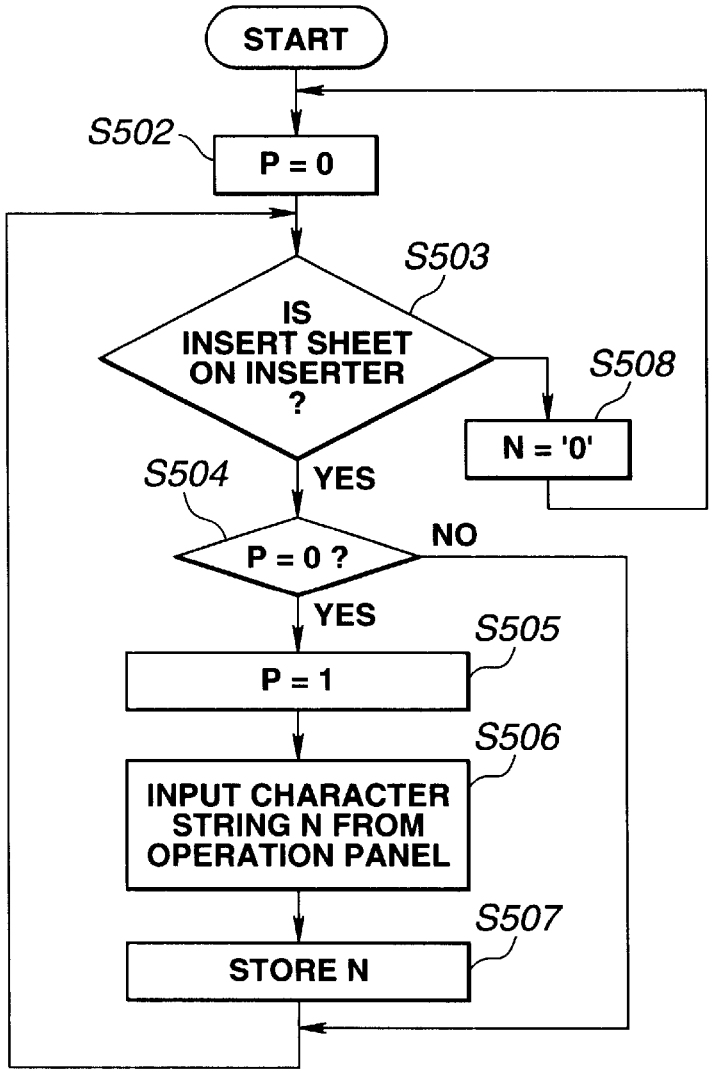
FIG. 5 shows a flowchart in the first embodiment.
Figure 6:
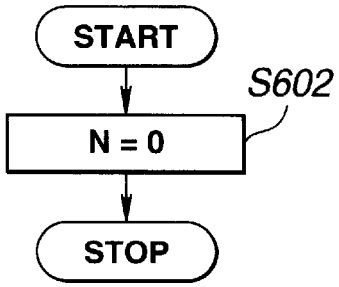
FIG. 6 shows a flowchart of initialization in the first embodiment.
Figure 8:
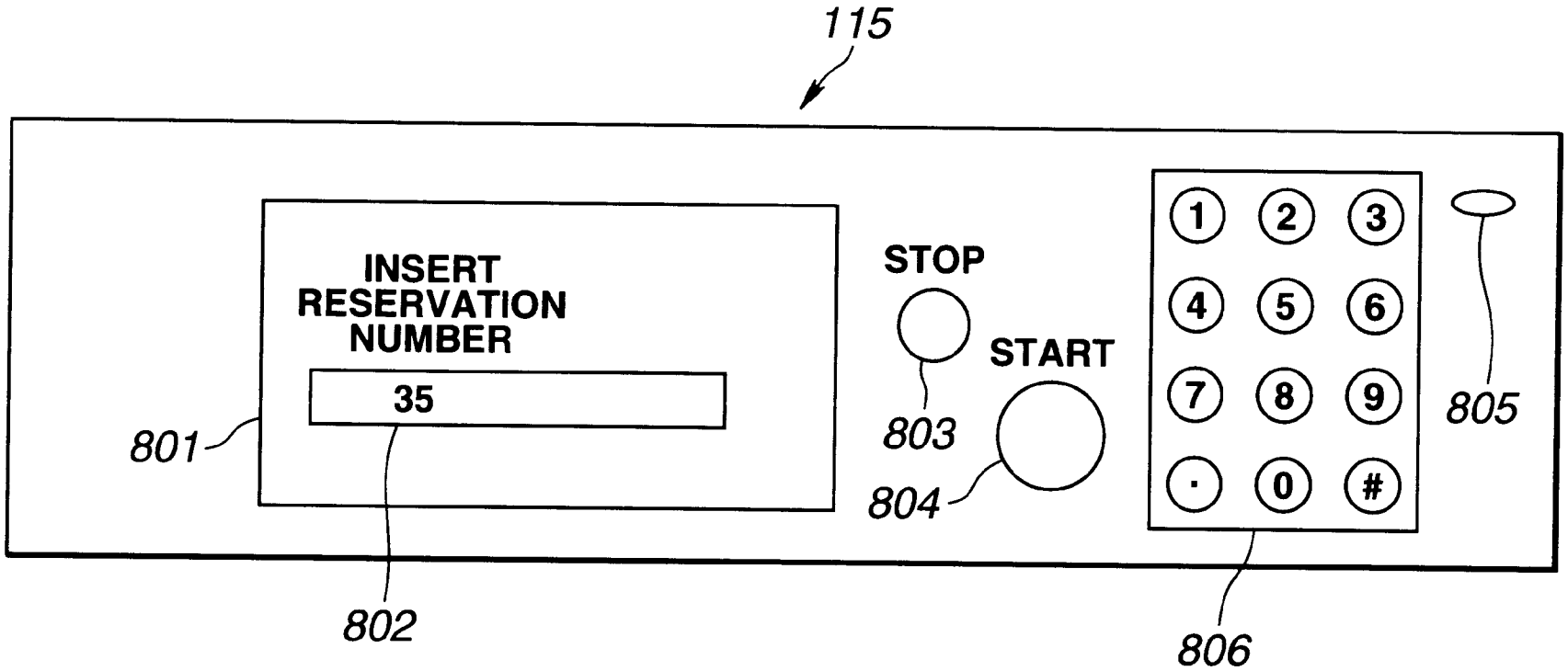
FIG. 8 shows a operation panel in the first embodiment.

CPU 114 executes the steps shown in FIG. 5 after executing those shown in FIG. 6. CPU 114 sets character string 0 in a variable P (S502). CPU 114 discriminates whether a insert sheet 231 is set on inserter 222 in accordance with the detection of sensor 225 (S503). If the insert sheet 231 is not set on inserter 222, CPU 114 sets a character string '0' in the variable N (S508), and returns to step S502. If the insert sheet 231 is set on inserter 222, CPU 114 discriminates whether the variable P is 0 (S504). If the variable P is 0, CPU 114 sets 1 in the variable P (S505). Then CPU 114 causes operation panel 115 to display a screen requesting an inserter reservation number as shown in FIG. 8 and inputs a character string N from operation panel 115 (S506). CPU 114 stores the character string N (S507), and returns to step S503 while still displaying the character string N on operation panel 115. The character string N is called an inserter reservation number in this embodiment. If the variable P is not 0 at step S504, CPU 114 proceeds step S503.

Therefore whenever new insert sheets are set on inserter 222, a new inserter reservation number can be input from operation panel 115 by the operator.

Figure 7:
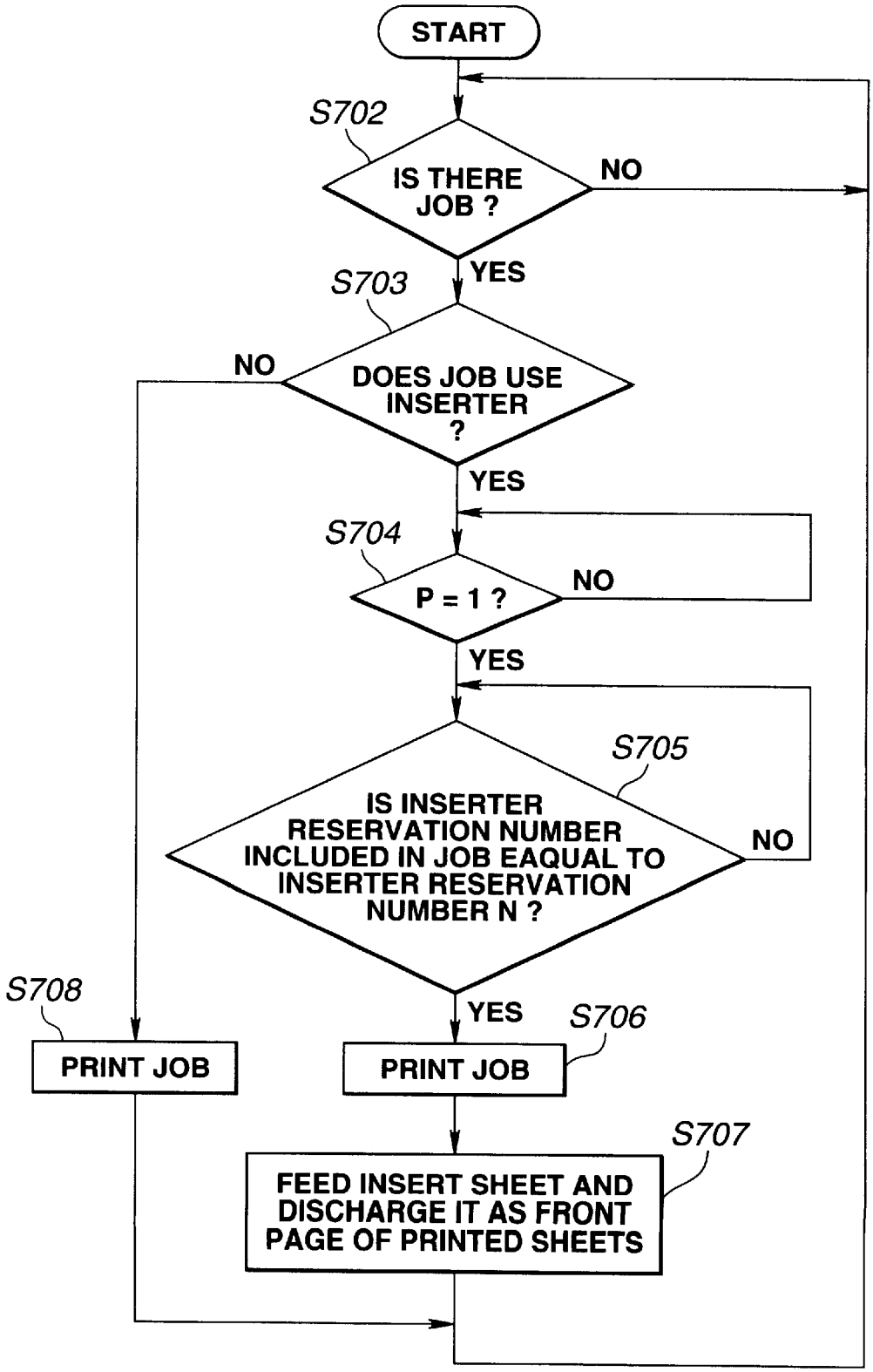
FIG. 7 shows a flowchart in the first embodiment.

FIG. 7 shows a flowchart executed by CPU 114 in parallel with the flowchart shown in FIG. 5. CPU 114 discriminates whether there is a job received from core unit 10 (S702). If there is a job, CPU 114 discriminates if the job uses inserter 222 based on designation data included in the job data (S703). If the job uses inserter 222, CPU 114 determines whether the variable P is 1 (S704). If the variable P is 1, (that is, insert sheets are set on inserter 222), CPU 114 advances to step S705. If the variable P is 0, CPU 114 waits at step S704 in for variable P to become 1.

Once variable P becomes 1 at step S704, CPU 114 discriminates whether an inserter reservation number included in the job data is equal to an inserter reservation number N input from operation panel 115 at step S506 (S705). If the inserter reservation numbers are the same, CPU 114 causes printer 2 to print in accordance with the job data (S706). Then CPU 114 controls sorter 220 to feed insert sheet 231 by inserter 222, and to discharge the insert sheet as a front page of the printed sheets on bin 223 (S707), and proceeds step S702. If the job does not use inserter 222 at step S703, CPU 114 causes printer 2 to print in accordance with the job (S708), and returns to step S702. If the inserter reservation numbers are different at step S705, CPU 114 returns to step S705 and waits for the input of a new inserter reservation number from operation panel 115. That is, unless inserter reservation number included in the job data is equal to inserter reservation number N input on the display panel, CPU 114 controls sorter 220 not to feed insert sheet 231 by inserter 222.

FIG. 8 shows operation panel 115. Numeral 801 indicates a touch panel which has a display and transparent keys. Numeral 802 indicates a number displayed on touch panel 801. The value input by keypad 806 at step S506 is displayed on touch panel 801. The input value is stored as inserter reservation number N. FIG. 8 shows that '3' and '5' are input by keypad 806 when insert sheets are set on inserter 222. Operation panel 115 has a stop key 803, start key 804, power indication lamp 805, and keypad 806. These keys are used for copy operations.

Figure 9:
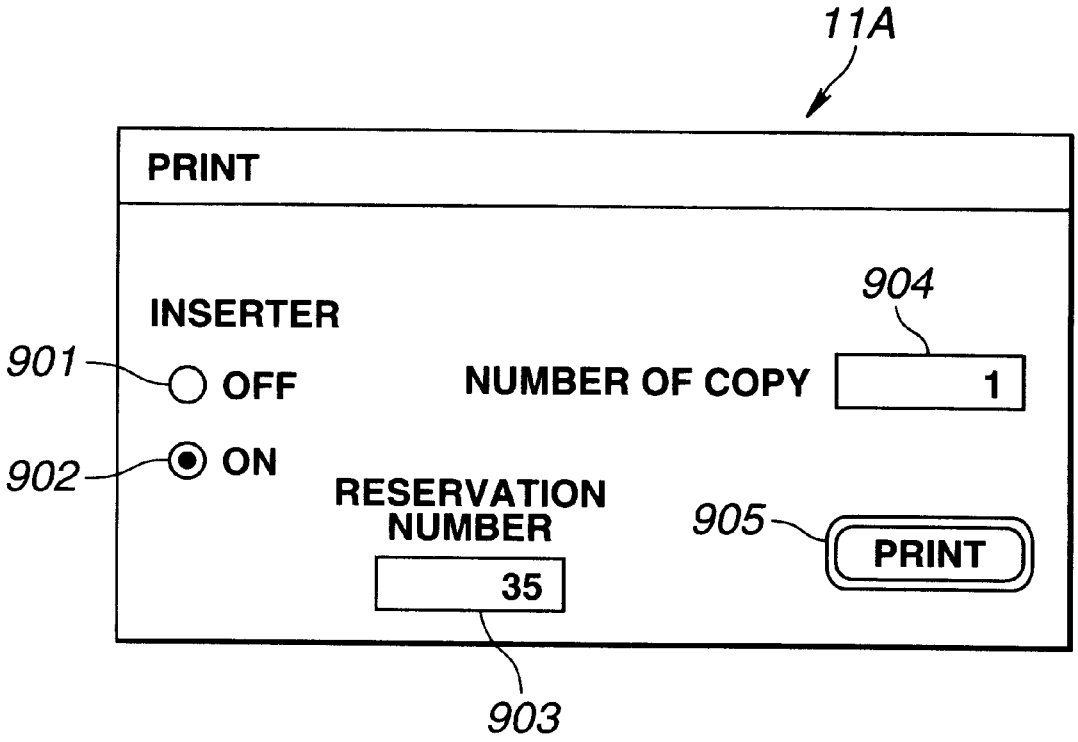
FIG. 9 shows a print designation screen of the personal computer in the first embodiment.

FIG. 9 shows print designation screen 11A displayed on the display of personal computer 11. The print designation screen 11A is displayed by a printer driver program executed by personal computer 11. The print designation screen 11*a* is displayed before print data are sent from personal computer 11 to printer 2. Button 902 should be clicked when inserter 222 will be used. Button 901 should be clicked when inserter 222 will not be used. Numeral 903 indicates a field for inputting the inserter reservation number when inserter 222 is used. Numeral 904 indicates a field for designating the number of copies of a print job. Numeral 905 indicates a print button for initiating the print operation by sending job data to core unit 10.

When the user commands to print data on an application software such as a word processing software, a drawing software, a calculating software, or the like, the printer driver software is executed and the print designation screen shown in FIG. 9 is displayed. The user inputs the inserter reservation number and clicks button 902 and then clicks print button 905. Then, the print job data are sent from personal computer 11 to image I/O control unit 3. The print job data includes designation data which designates whether inserter 222 should be used as well as the inserter reservation number.

When the user desires to get a document with a cover sheet by inserter 222, the user prepares the desired number of cover sheets in advance. Then, the user sets the cover sheets as the inserter sheets on inserter 222 and inputs the inserter reservation number by keypad 806. The inserter reservation number is displayed as shown in FIG. 8. Then, the user inputs the same inserter reservation number on the screen 11*a* and clicks print button 905. Personal computer 11 sends the print job data to printer 2 upon clicking print button 905, and printer 2 prints in accordance with the print job data and controls inserter 222 to feed the cover sheet and stack it on the printed sheets.

Although the user sets the insert sheet (cover sheet) before designating the printing at personal computer 11 in the above procedure, the user also can set the insert sheet after designating the printing at personal computer 11. First of all, the user inputs an arbitrary insert reservation number on personal computer 11 as shown in FIG. 9 and clicks print button 905. Personal computer 11 sends print data with the insert reservation number to the image forming apparatus. Then, the user sets a cover sheet on inserter 222 and inputs the same insert reservation number into operation panel 115. Printer 2 prints in accordance with the print job and controls inserter 222 to feed the cover sheet and stack it on the printed sheets. Thereby, the user does not have to walk many times between personal computer 11 and the image forming apparatus.

Figure 10:
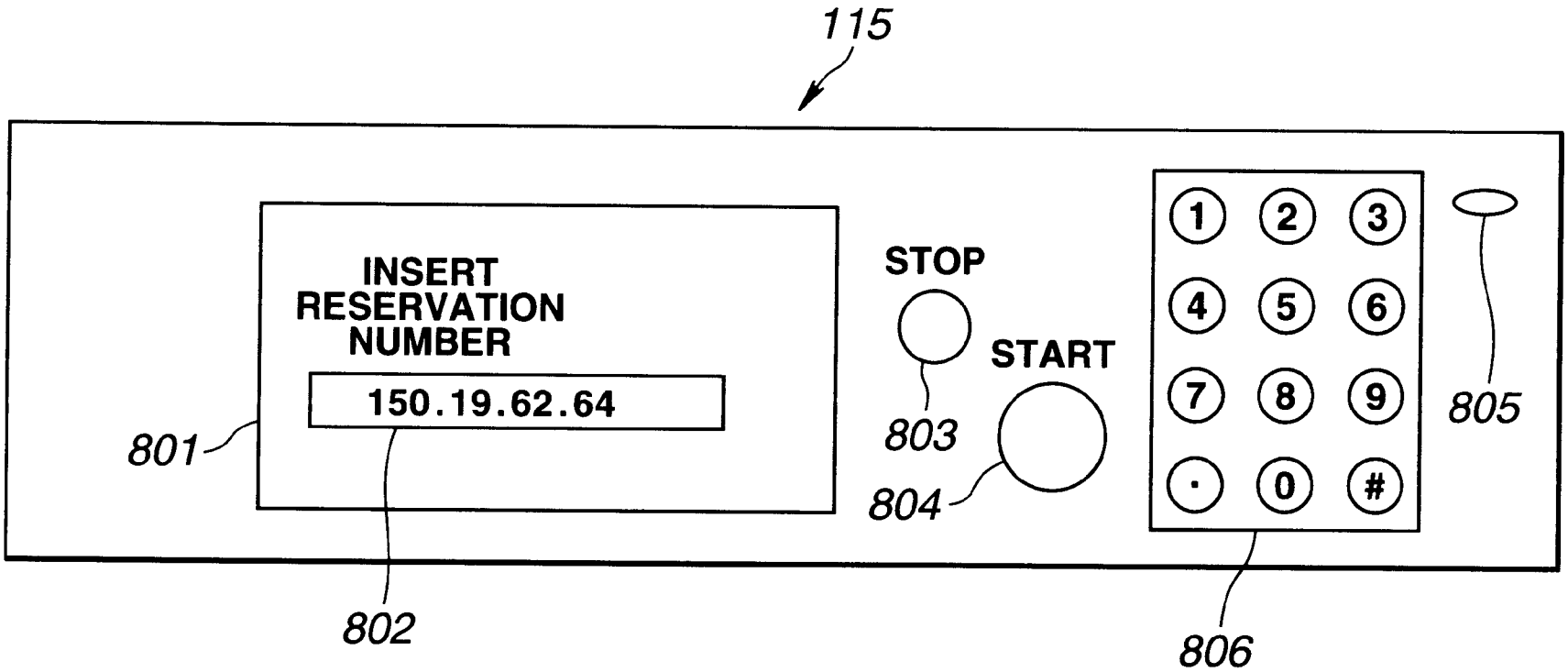
FIG. 10 shows a operation panel in the second embodiment.
Figure 11:
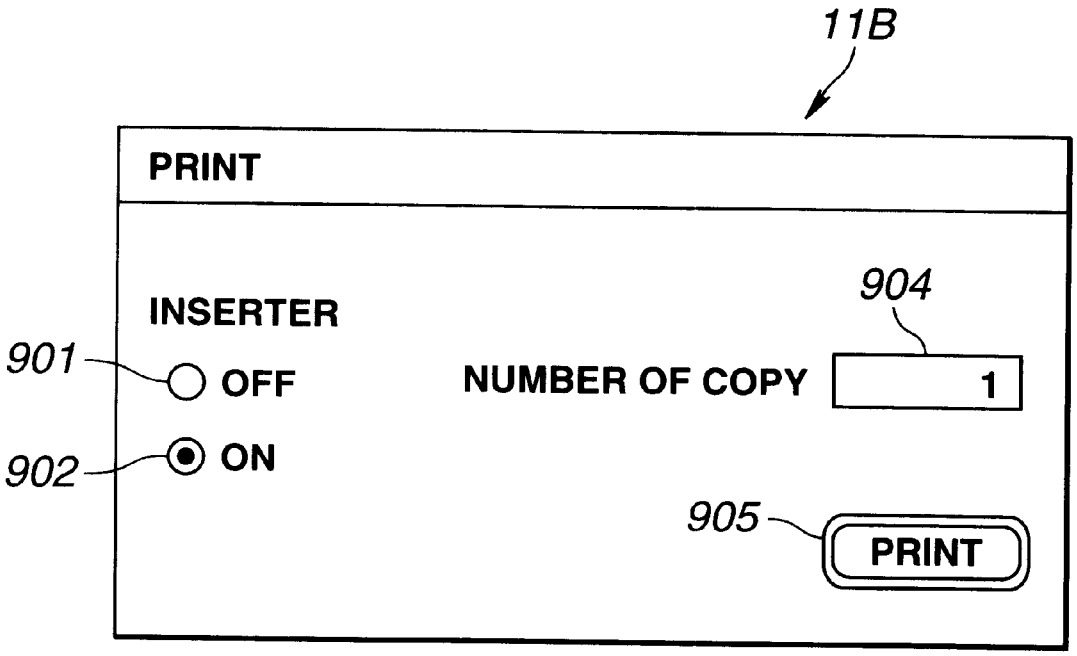
FIG. 11 shows a print designation screen of the personal computer in the second embodiment.

A second embodiment will be described with reference to FIGS. 10 and 11 hereinafter. The same numerals as the first embodiment will be used when those are common. FIG. 10 shows operation panel 115 and the network address 802 (here, an IP address) input as the insert reservation number. FIG. 11 shows print designation screen 11B displayed on personal computer 11. Print designation screen 11B does not have a field for inputting the insert reservation number. The user designates to use inserter 222 or not and does not have to input the insert reservation number. Personal computer 11 sends print data with the predetermined network address to printer 2 instead of sending the insert reservation number. Then, the user sets a cover sheet on inserter 222 and inputs his/her network address by operation panel 115 as shown in FIG. 10. Printer 2 prints in accordance with the print job and controls inserter 222 to feed the cover sheet and stack it on the printed sheets.

A third embodiment will be described hereinafter. The processing shown in FIG. 6 is executed once when the power of the image forming apparatus is turned on in third embodiment as well. When the image forming apparatus is turned on, CPU 114 sets 0 in a variable N (S602).

Figure 12:
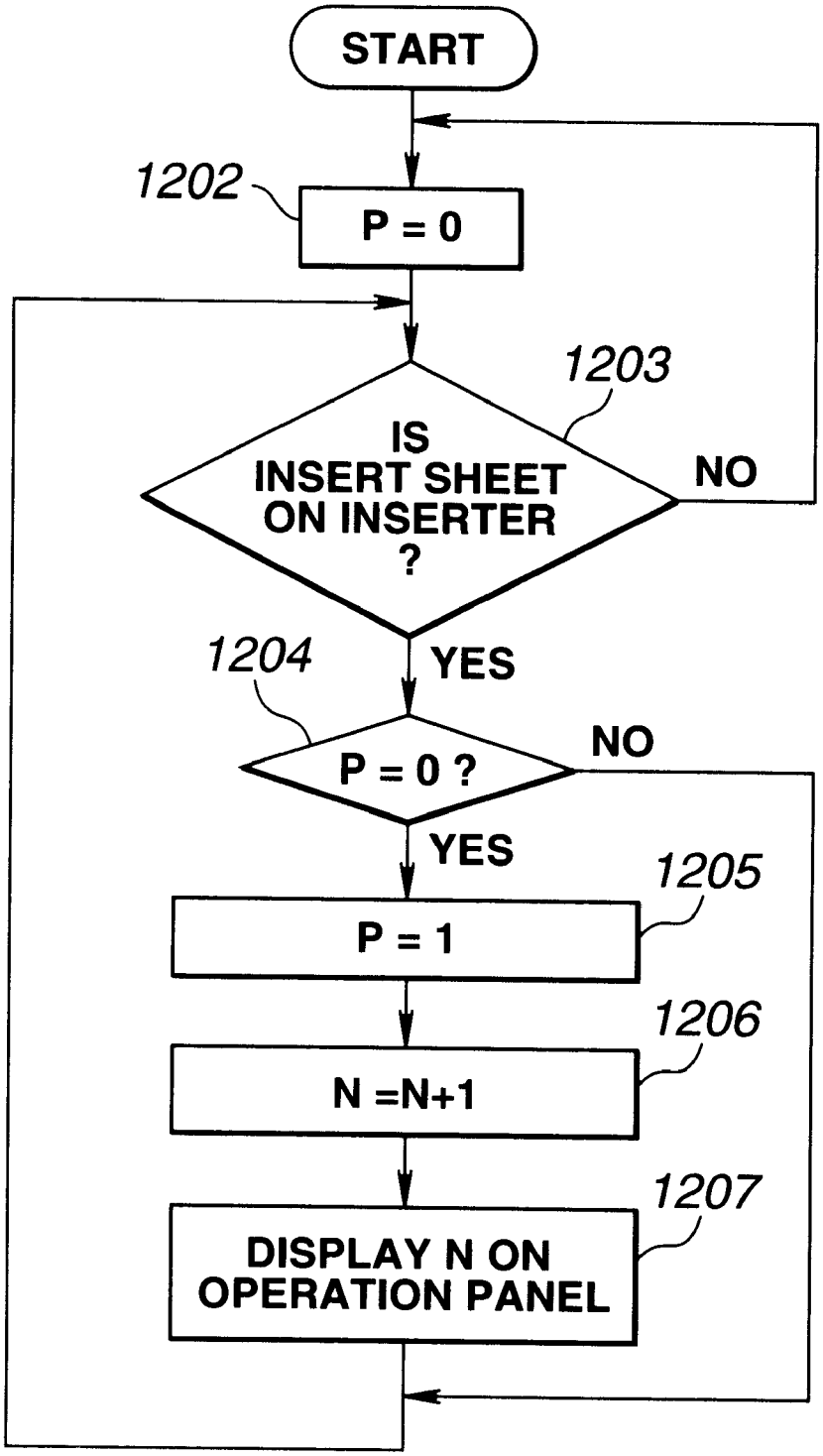
FIG. 12 shows a flowchart in the third embodiment.

CPU 114 executes a flowchart shown in FIG. 12 after executing the flowchart shown in FIG. 6. CPU 114 sets 0 in a variable P (S1202). CPU 114 discriminates whether a insert sheet 231 is set on inserter 222 in accordance with a detection of sensor 225 (S1203). If the insert sheet 231 is not set on inserter 222, CPU 114 returns to step S1202. If the insert sheet 231 is set on inserter 222, CPU 114 discriminates whether the variable P is 0 (S1204). If the variable P is 0, CPU 114 sets 1 in the variable P (Sl205). Then CPU 114 increments the variable N (S1206). CPU 114 cause operation panel 115 to display the variable N (S1207), such as the display of the numeral "35" shown in FIG. 8, and proceeds to step S1203 while maintaining the display of variable N on operation panel 115. The variable N is called an inserter reservation number in this embodiment. If the variable P is not 0 at step S1204, CPU 114 returns to step S1203.

Therefore whenever new insert sheets are set on inserter 222, a new inserter reservation number can be displayed on operation panel 115.

Figure 13:
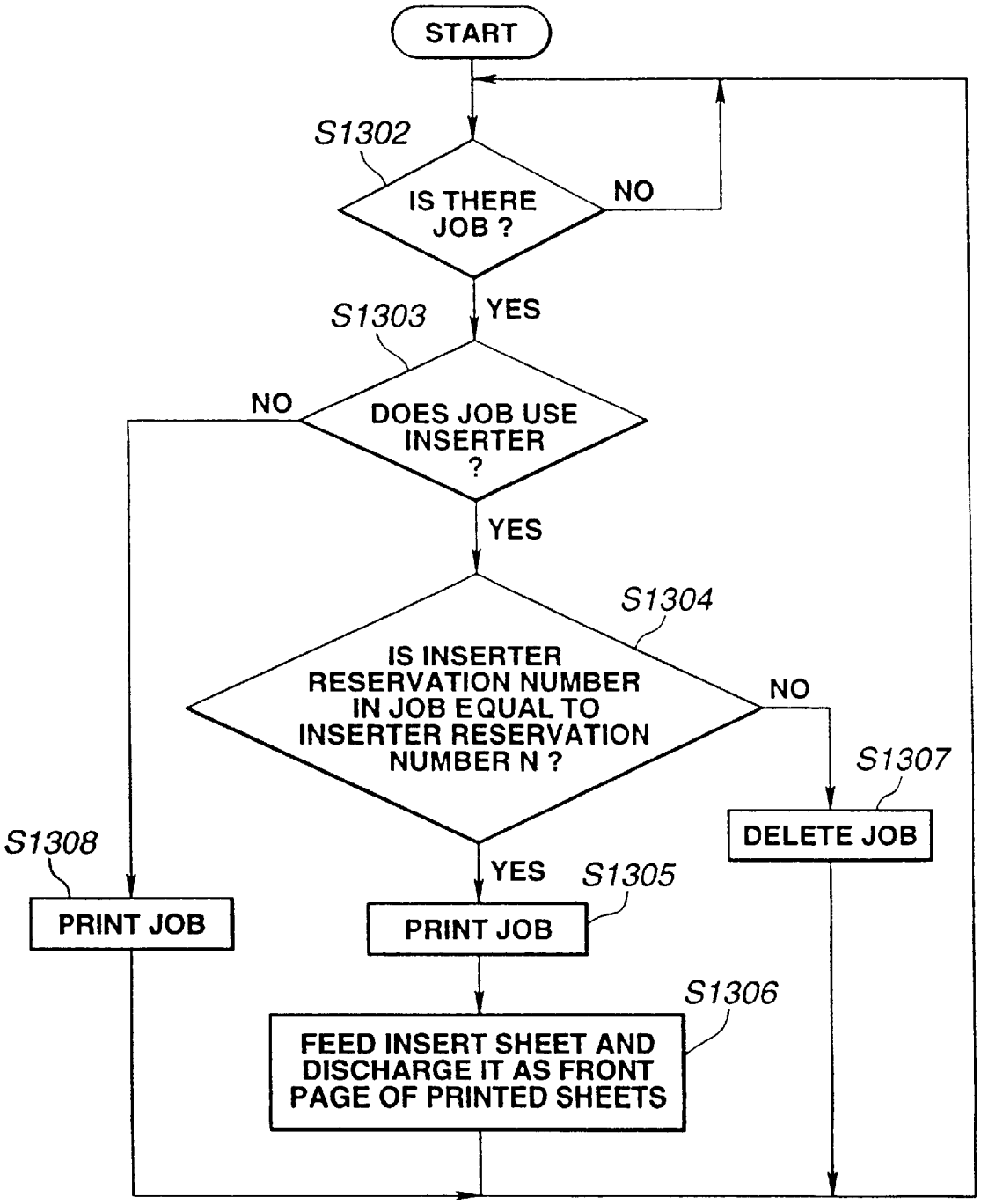
FIG. 13 shows a flowchart in the third embodiment.

FIG. 13 shows a flowchart executed by CPU 114 in parallel with the process shown in FIG. 12. CPU 114 discriminates whether there is a job received from core unit 10 (S1302). If there is a job, CPU 114 discriminates if the job uses inserter 222 based on the designation data included in the job data (S1303). If the job uses inserter 222, CPU 114 discriminates whether an inserter reservation number included in job data is equal to an inserter reservation number N input from operation panel 115 (S1304). If the inserter reservation numbers are the same in step S1304, CPU 114 causes printer 2 to print in accordance with the job data (S1305). Then CPU 114 controls sorter 220 to feed insert sheet 231 by inserter 222, and discharge the insert sheet as a front page of the printed sheets on bin 223 (S1306), and returns to step S1302. If the job does not use inserter 222 at step S1303, CPU 114 causes printer 2 to print in accordance with the job (S1308), and returns to step S1302. If the inserter reservation numbers are different at step S1304, CPU 114 deletes the job data (S1307) and returns to step S1302 and waits for a next job. That is, unless inserter reservation number included in the job data is equal to inserter reservation number N, CPU 114 controls sorter 220 not to feed insert sheet 231 by inserter 222.

Figure 14:
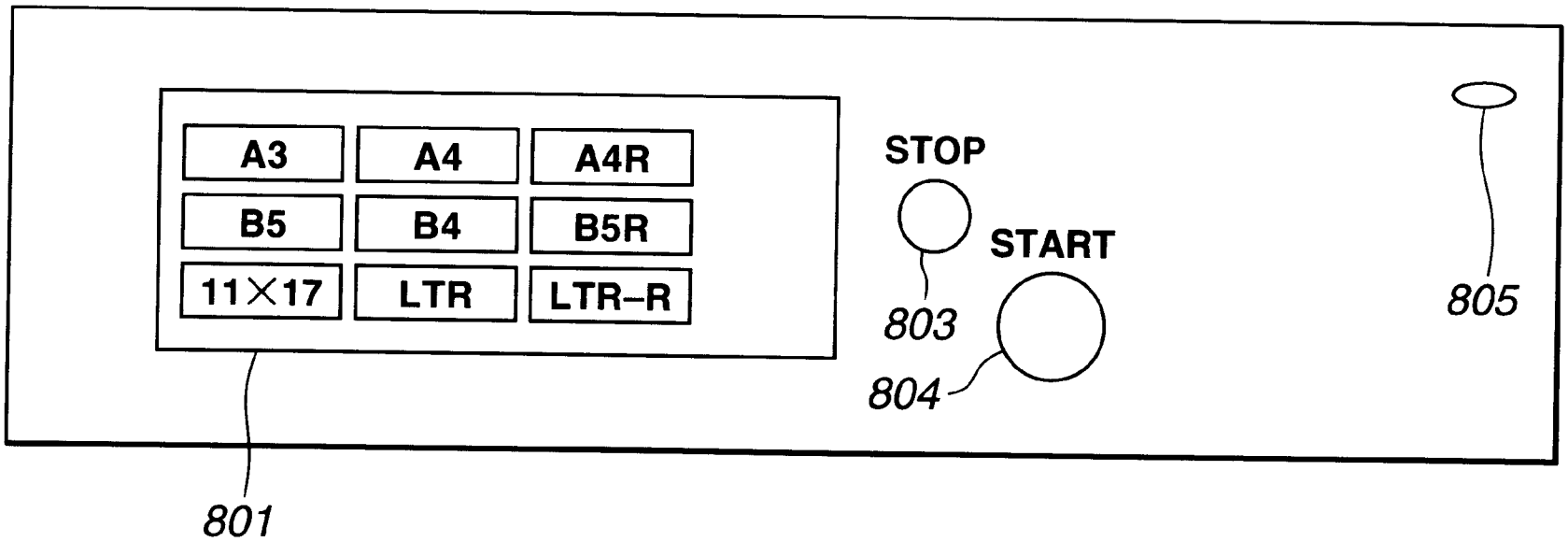
FIG. 14 shows a operation panel in the fourth embodiment.
Figure 15:
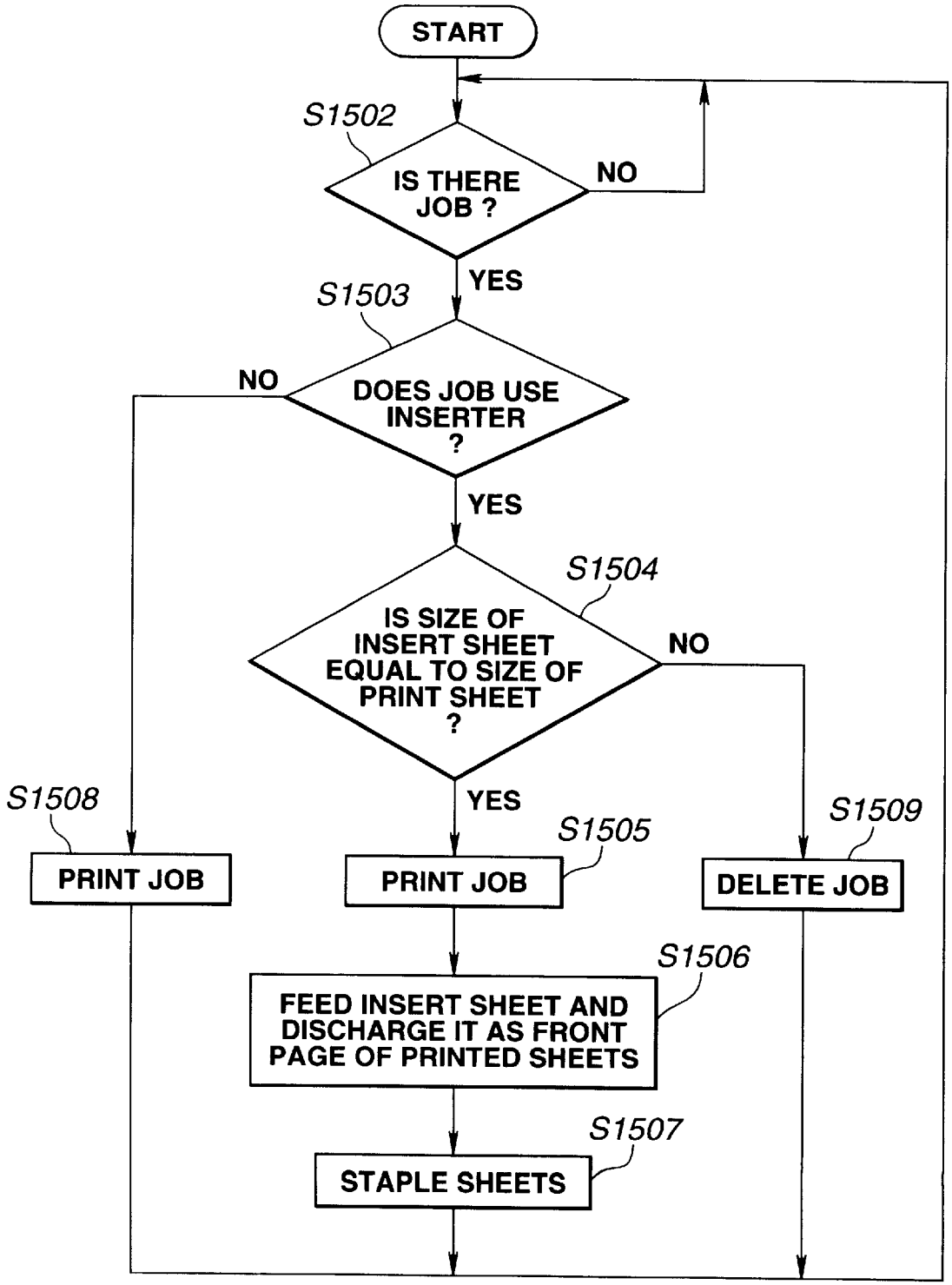
FIG. 15 shows a flowchart in the fourth embodiment.

A fourth embodiment will be described hereinafter with reference to FIGS. 14 and 15. FIG. 14 shows a sheet size select screen displayed on operation panel 115 upon setting insert sheet 231 on inserter 222. The sheet size of insert sheet 231 can be designated by touching the area corresponding to the size of insert sheet 231.

In the fourth embodiment, when the size of print sheet to be printed in accordance with a job is not equal to the size of insert sheet, the job is deleted. FIG. 15 shows a flowchart executed by CPU 114. CPU 114 discriminates whether there is a job received from core unit 10 (S1S02). If there is a job, CPU 114 discriminates if the job uses inserter 222 (S1503). If the job uses inserter 222, CPU 114 discriminates whether the size of an insert sheet input by operation panel 115 is equal to the size of print sheets designated by the job (S1504). If the sizes are the same in step S1504, CPU 114 causes printer 2 to print in accordance with the job data (Sl5O5). Then CPU 114 controls sorter 220 to feed the set insert sheet by inserter 222, and discharge the insert sheet as a front page of the printed sheets on bin 223 (S1506). CPU 114 causes sorter 220 to staple the sheets on bin 223 (S1507) and returns to step S1502. If the job does not use inserter 222 at step S1503, CPU 114 causes printer 2 to print in accordance with the job (S1508), and returns to step S1502. If the sizes are different at step S1504, CPU 114 deletes the job data (S1509) and returns to step S1502 and waits for a next job.

Thereby, when the size of the insert sheet as the front page is not equal to the size of the print sheets, unwanted stapling of the insert sheet and the print sheets can be avoided.

Figure 16:
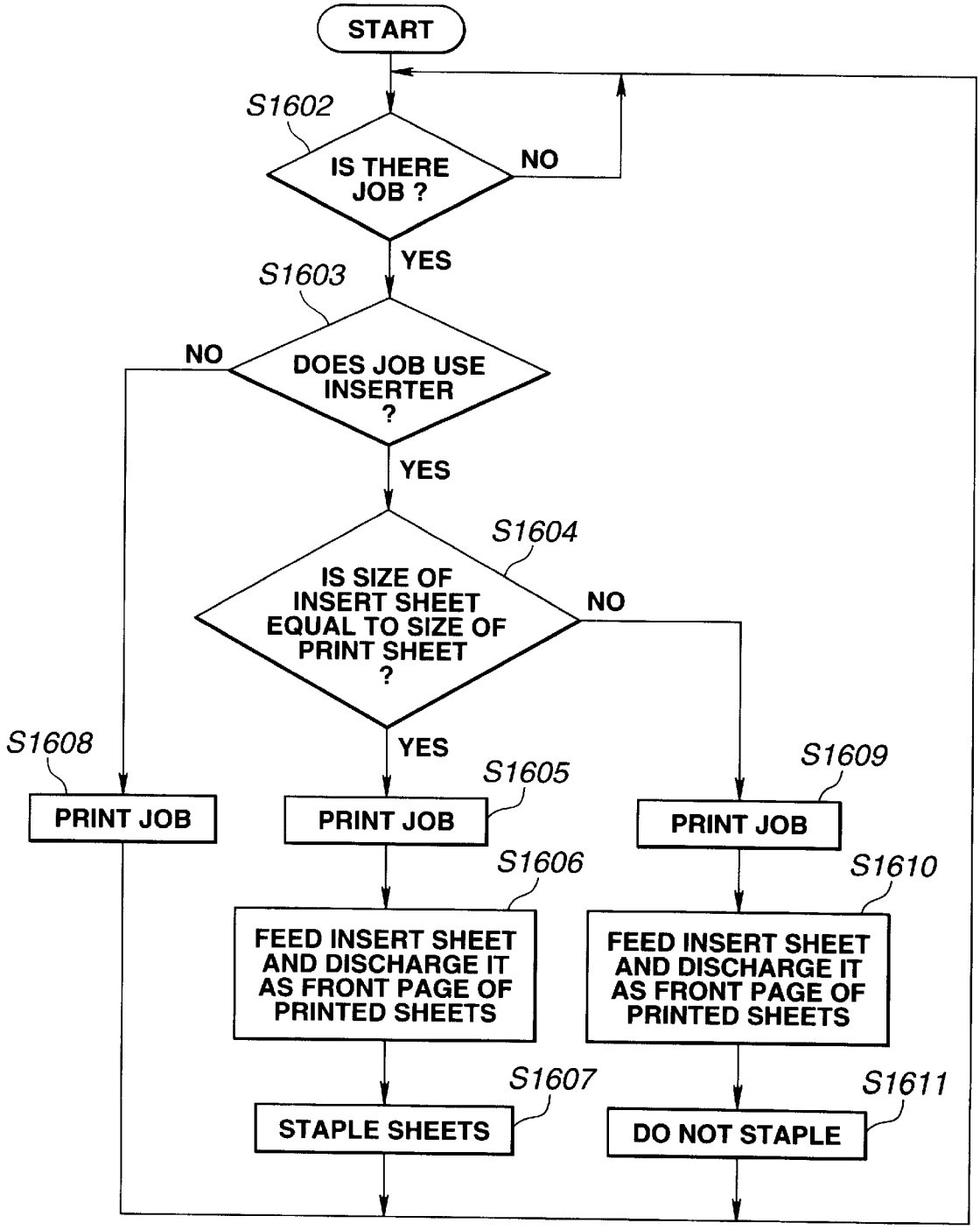
FIG. 16 shows a flowchart in the fifth embodiment.

The fifth embodiment will be described hereinafter with reference to FIG. 16. In the fifth embodiment, when the size of a print sheet to be printed in accordance with a job is not equal to the size of insert sheet, the job is executed without stapling. FIG. 16 shows a flowchart executed by CPU 114.

CPU 114 discriminates whether there is a job received from core unit 10 (S1602). If there is a job, CPU 114 discriminates if the job uses inserter 222 (S1603). If the job uses inserter 222, CPU 114 discriminates whether the size of an insert sheet input by operation panel 115 is equal to the size of print sheets designated by the job (S1604). If the sizes are the same in step S1604, CPU 114 causes printer 2 to print in accordance with the job data (Sl605). Then CPU 114 controls sorter 220 to feed the set insert sheet by inserter 222, and discharge the insert sheet as a front page of the printed sheets on bin 223 (S1606). CPU 114 causes sorter 220 to staple the sheets on bin 223 (S1607) and returns to step S1602. If the job does not use inserter 222 at step S1603, CPU 114 causes printer 2 to print in accordance with the job (S1608), and returns to step S1602. If the sizes are different at step S1604, CPU 114 causes printer 2 to print in accordance with the job data (S1609). Then CPU 114 controls sorter 220 to feed the set insert sheet by inserter 222, and discharge the insert sheet as a front page of the printed sheets on bin 223 (S1610). CPU 114 does not cause sorter 220 to staple (S1611) and returns to step S1602 and waits for a next job.

Thereby, when the size of the insert sheet as the front page is not equal to the size of the print sheets, unwanted stapling of the insert sheet and the print sheets can be avoided, but the printing is executed.

In a case where the image forming apparatus in the first and second embodiment is connected to a plurality of personal computers 11 through a network, more than one print job including inserter reservation numbers could be sent to the image forming apparatus at the same time, or a second print job including an inserter reservation number could be sent to the image forming apparatus before a first print job is completed. The sixth embodiment will be described with reference to FIG. 17 in view of the above situation.

Figure 17:
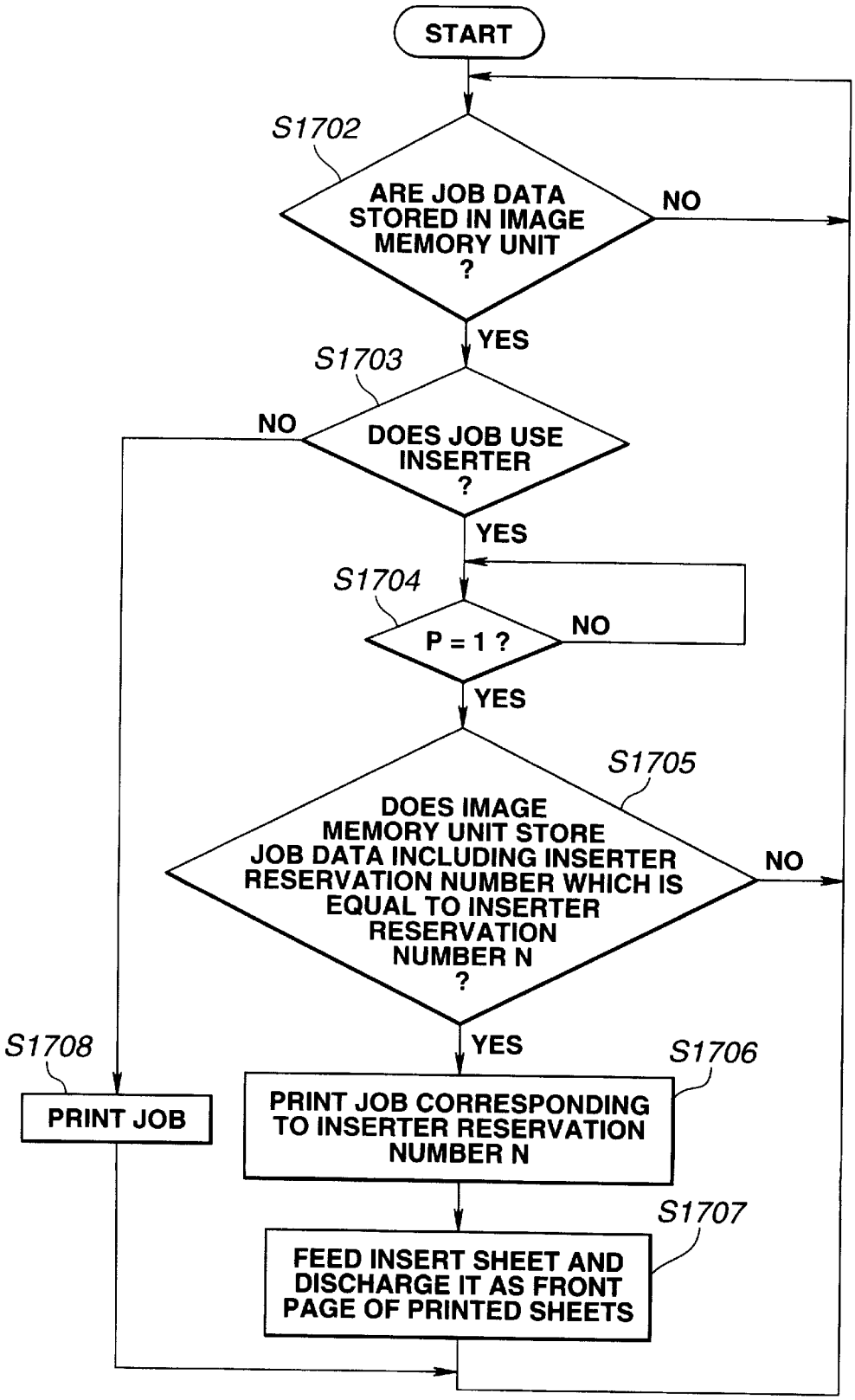
FIG. 17 shows a flowchart in the sixth embodiment.

FIG. 17 shows a flowchart executed by CPU 114 in parallel with the flowchart shown in FIG. 5. The job data received from personal computer 11 is stored in image memory unit 9 until the job data is printed. Image memory unit 9 can store a plurality of job data. CPU 114 discriminates whether job data from a print job received from personal computer 11 is stored in image memory unit 9 (S1702). If job data is stored, CPU 114 discriminates if the print job uses inserter 222 based on the designation data included in the job data (S1703). If the job uses inserter 222, CPU 114 determines whether the variable P is 1 (S1704). If the variable P is 1 (that is, insert sheets are set on inserter 222), CPU 114 advances to step S1705. If the variable P is 0, CPU 114 returns to step S1704 in order to wait for variable P to become 1.

If the variable P is 1 at step S1704, CPU 114 determines whether image memory unit 9 stores the job data including an inserter reservation number which is equal to an inserter reservation number N input from operation panel 115 at step S506 (S1705). If image memory unit 9 stores job data including an inserter reservation number which is equal to inserter reservation number N, CPU 114 causes printer 2 to print in accordance with the job data corresponding to the inserter reservation number N (S1706). Then CPU 114 controls sorter 220 to feed insert sheet 231 by inserter 222, and to discharge the insert sheet as a front page of the printed sheets on bin 223 (S1707), and then returns to step S1702.

If image memory unit does not store the job data including the inserter reservation number which is equal to inserter reservation number N at step S1705, CPU 114 returns to step S1702. If the job does not use inserter 222 at step S1703, CPU 114 causes printer 2 to print in accordance with the job (S1708), and returns to step S1702. If the inserter reservation numbers are different at step S1705, CPU 114 returns to step S1705 and waits for input of a new inserter reservation number from operation panel 115. That is, unless image memory unit 9 stores job data including an inserter reservation number which is equal to inserter reservation number N, CPU 114 controls sorter 220 not to feed insert sheet 231 by inserter 222.

In the aforementioned embodiments, the image formation operation was illustrated as a print job, but jobs other than print jobs can be applied to the embodiments.

In the aforementioned embodiments, the sheet fed from inserter 222 does not go through fixing roller 207. For this reason, the color quality of the insert sheet (which is ordinarily a color image printed by a color printer or a color copier) does not degrade. However, if degradation in quality does not matter, the insert sheet could be fed from one of cassettes 204 and 205 and manual feed unit 224.

The various embodiments can be combined, and in particular, the fourth and fifth embodiments could be combined with the first through third and sixth embodiments. For example, when the inserter reservation number of the image forming apparatus and the inserter reservation number included in the job sent from personal computer 11 are the same, and the size of the insert sheet and the size of the print sheet are the same, inserting, printing, and stapling are performed. When the inserter reservation numbers are the same and the size of the insert sheet and the size of the print sheet are different, the inserting and printing are performed but the stapling is not. When the inserter reservation numbers are different, printing only is performed and inserting is not.

The printer driver program, which causes display on personal computer 11, is stored in a computer readable medium such as a hard disc of personal computer 11. The printer driver program can be stored in a floppy disc and a CD-ROM and distributed. The printer driver program can be distributed over the Internet as well.

This invention can be applied to either an apparatus comprising a plurality of devices (e.g. a personal computer, an interface device, a reader, and a printer) or an apparatus comprising one device (e.g. a copier or a facsimile).

It is to be understood that the invention is not limited in its application to the details of the description and drawings. Also it is to be understood that the phraseology or terminology employed herein is for the purpose of description and not of limitation.

What is claimed is:

1. An image forming apparatus comprising:

a print sheet feeder for feeding a print sheet;

a first terminal for receiving job data and an identification of the job data from another apparatus;

image forming means for forming images on the print sheets fed by said print sheet feeder in accordance with the job data received by said first terminal;

an insert sheet feeder for feeding an insert sheet;

a second terminal for receiving an identification of the insert sheet; and a controller for discriminating whether the identification of the job data corresponds to the identification of the insert sheet, and for controlling said insert sheet feeding to feed the insert sheet in a case where the identification of the job data corresponds to the identification of the insert sheet.

2. The image forming apparatus according to claim 1, further comprising a detector for detecting if the insert sheet is set on said insert sheet feeder, wherein said second terminal receives the identification of the insert sheet in accordance with a detection of said detector.

3. The image forming apparatus according to claim 1, wherein the insert sheet fed by said insert sheet feeder is discharged without going through said image forming means.

4. The image forming apparatus according to claim 1, further comprising discharging means for discharging the print sheet and the insert sheet to a discharge tray.

5. The image forming apparatus according to claim 1, wherein said controller controls said insert sheet feeder not to feed the insert sheet when the identification of the job data is not equal to the identification of the insert sheet.

6. The image forming apparatus according to claim 1, wherein said another apparatus is a personal computer connected to said printing apparatus through a network.

7. The image forming apparatus according to claim 1, wherein said identification of the insert sheet is a network address of the another apparatus.

8. The image forming apparatus according to claim 7, wherein said another apparatus is a personal computer connected to said printing apparatus through a network and said identification is a network address of said personal computer on said network.

9. The image forming apparatus according to claim 1, wherein said controller includes a generator for generating an identification of the insert sheet set on said insert sheet feeder, wherein said second terminal receives the identification from said generator.

10. The image forming apparatus according to claim 9, further comprising a detector for detecting if the insert sheet is set on said insert sheet feeder, wherein said generator generates the identification of the insert sheet in accordance with a detection of said detecting means.

11. The image forming apparatus according to claim 9, further comprising deleting means for deleting the image data received by said receiving means when the identification received by said first terminal is not equal to the identification generated by said generator.

12. The image forming apparatus according to claim 9, wherein said another apparatus is a personal computer connected to said printing apparatus through a network.

13. The image forming apparatus according to claim 1, further comprising memory for storing the job data received by said first terminal; and a print controller for controlling said image forming means to form the image data including the identification corresponding to the identification received by said second terminal.

14. The image forming apparatus according to claim 13, wherein said print control means controls said image forming means not to form the image data including the identification when said storing means stores no image data including the identification being equal to the identification input by said second terminal.

15. The image forming apparatus according to claim 1, said second terminal includes an operation panel for inputting the identification of the insert sheet.

16. An image forming method for use in an image forming apparatus including a print sheet feeder for feeding print sheets and an insert sheet feeder for feeding an insert sheet, said method comprising the steps of:

receiving job data and an identification of the job data at a first terminal from another apparatus;

forming images on the print sheets fed from the print sheet feeder in accordance with the received job data;

feeding the insert sheet with the insert sheet feeder;

receiving identification data corresponding to an identification of the insert sheet at a second terminal;

discriminating whether the identification of the job data corresponds to the identification data of the insert sheet; and controlling the insert sheet feeder to feed the insert sheet when the identification of the job data corresponds to the identification data of the insert sheet.

17. The image forming method according to claim 16, further comprising a step of detecting if the insert sheet is set on the insert sheet feeder, wherein the second terminal receives the identification data corresponding to the identification of the insert sheet in accordance with a detection made during said detecting step.

18. The image forming method according to claim 16, further comprising a step of discharging the insert sheet, wherein the insert sheet fed by the insert sheet feeder is discharged without going through said image forming step.

19. The image forming method according to claim 16, further comprising a step of discharging the print sheet and the insert sheet to a discharge tray.

20. The image forming method according to claim 16, wherein said controlling step controls the insert sheet feeder so as not to feed the insert sheet when the job data is not equal to the identification data corresponding to the identification of the insert sheet.

21. The image forming method according to claim 16, wherein the another apparatus is a personal computer connected to the image forming apparatus through a network.

22. The image forming method according to claim 16, wherein the identification data corresponding to the identification of the insert sheet is a network address of the another apparatus.

23. The image forming method according to claim 22, wherein the another apparatus is a personal computer connected to the image forming apparatus through a network and the identification data corresponding to the identification of the insert sheet is a network address of the personal computer on the network.

24. The image forming method according to claim 16, wherein said controlling step includes a step of generating data corresponding to an identification of the insert sheet set on the insert sheet feeder, and the second terminal receives data corresponding to the identification of the insert sheet from said generating step.

25. The image forming method according to claim 24, further comprising a step of detecting if the insert sheet is set on the insert sheet feeder, wherein said generating step generates the data corresponding to the identification of the insert sheet in accordance with a detection made during said detecting step.

26. The image forming method according to claim 24, further comprising a step of deleting the image data received during said receiving step when the data corresponding to the identification of the insert sheet received by the first terminal is not equal to the identification data generated by said generating step.

27. The image forming method according to claim 24, wherein the another apparatus is a personal computer connected to the image forming apparatus through a network.

28. The image forming method according to claim 16, further comprising a step of storing in a memory the job data received by the first terminal in said receiving step; and a step of controlling said image forming step to form the image data including the identification data corresponding to the identification of the insert sheet received by the second terminal.

29. The image forming method according to claim 28, wherein said controlling step controls said image forming step so as not to form the image data including the identification data when the memory does not include data equal to the identification input by the second terminal.

30. The image forming method according to claim 16, further comprising a step inputting the data corresponding to the identification of the insert sheet at the second terminal on an operation panel.

31. A recording medium having computer readable program codes embodied therein for performing a method for use in an image forming apparatus including a print sheet feeder for feeding print sheets and an insert sheet feeder for feeding an insert sheet, said method comprising the steps of:

receiving job data and an identification of the job data at a first terminal from another apparatus;

forming images on the print sheets fed from the print sheet feeder in accordance with the received job data;

feeding the insert sheet with the insert sheet feeder;

receiving identification data corresponding to an identification of the insert sheet at a second terminal;

discriminating whether the identification of the job data corresponds to the identification data of the insert sheet; and controlling the insert sheet feeder to feed the insert sheet when the identification of the job data corresponds to the identification data of the insert sheet.

32. The recording medium according to claim 31, further comprising code for performing a step of detecting if the insert sheet is set on the insert sheet feeder, wherein the second terminal receives the identification data corresponding to the identification of the insert sheet in accordance with a detection made during said detecting step.

33. The recording medium according to claim 31, further comprising code for performing a step of discharging the insert sheet, wherein the insert sheet fed by the insert sheet feeder is discharged without going through said image forming step.

34. The recording medium according to claim 31, further comprising code for preforming a step of discharging the print sheet and the insert sheet to a discharge tray.

35. The recording medium according to claim 31, wherein said controlling step controls the insert sheet feeder so as not to feed the insert sheet when the job data is not equal to the identification data corresponding to the identification of the insert sheet.

36. The recording medium according to claim 31, wherein the another apparatus is a personal computer connected to the image forming apparatus through a network.

37. The recording medium according to claim 31, wherein the identification data corresponding to the identification of the insert sheet is a network address of the another apparatus.

38. The recording medium according to claim 37, wherein the another apparatus is a personal computer connected to the image forming apparatus through a network and the identification data corresponding to the identification of the insert sheet is a network address of the personal computer on the network.

39. The recording medium according to claim 31, wherein said controlling step includes a step of generating data corresponding to an identification of the insert sheet set on the insert sheet feeder, and the second terminal receives data corresponding to the identification of the insert sheet from said generating step.

40. The recording medium according to claim 39, further comprising code for performing a step of detecting if the insert sheet is set on the insert sheet feeder, wherein said generating step generates the data corresponding to the identification of the insert sheet in accordance with a detection made during said detecting step.

41. The recording medium according to claim 39, further comprising code for performing a step of deleting the image data received during said receiving step when the data corresponding to the identification of the insert sheet received by the first terminal is not equal to the identification data generated by said generating step.

42. The recording medium according to claim 39, wherein the another apparatus is a personal computer connected to the image forming apparatus through a network.

43. The recording medium according to claim 31, further comprising code for performing a step of storing in a memory the job data received by the first terminal in said receiving step; and a step of controlling said image forming step to form the image data including the identification data corresponding to the identification of the insert sheet received by the second terminal.

44. The recording medium according to claim 43, wherein said controlling step controls said image forming step so as not to form the image data including the identification data when the memory does not include data equal to the identification input by the second terminal.

45. The recording medium according to claim 31, further comprising code for performing a step inputting the data corresponding to the identification of the insert sheet at the second terminal on an operation panel.

* * * * *

UNITED STATES PATENT AND TRADEMARK OFFICE

CERTIFICATE OF CORRECTION

PATENT NO. : 6,311,029 B1
DATED : October 30, 2001
INVENTOR(S) : Hiroshi Sumio et al.

It is certified that error appears in the above-identified patent and that said Letters Patent is hereby corrected as shown below:

Title page,
Item [57], ABSTRACT,
Line 9, "a" should read -- an -- ; and.
Line 11, "for" should read -- to --.

Column 2,
Line 2 "a" should read -- an --;
Line 5, "a" should read -- an --;
Line 11, "a" should read -- an --; and
Line 58, "flow" should read -- the flow --.

Column 3,
Line 50, "compensation" should read -- compensation of --.

Column 4,
Line 38, "a" should read -- an --;
Line 52, "proceeds" should read -- proceeds to --;
Line 54, "Therefore" should read -- Therefore, --; and
Line 67, "in" should be deleted.

Column 6,
Line 52, "Therefore" should read -- Therefore, --.

Column 9,
Line 26, "Also" should read -- Also, --.

Signed and Sealed this

Ninth Day of April, 2002

*Attest:*

*Attesting Officer*

JAMES E. ROGAN
*Director of the United States Patent and Trademark Office*